US006904897B1

(12) United States Patent
Hrytzak

(10) Patent No.: US 6,904,897 B1
(45) Date of Patent: Jun. 14, 2005

(54) BEARING POROSITY CONTROL IN AN EXHAUST GAS RECIRCULATION VALVE

(75) Inventor: Bernard J. Hrytzak, Chatham (CA)

(73) Assignee: Siemens VDO Automotive Inc., Chatham (CA)

( * ) Notice: Subject to any disclaimer, the term of this patent is extended or adjusted under 35 U.S.C. 154(b) by 0 days.

(21) Appl. No.: 10/794,135

(22) Filed: Mar. 5, 2004

(51) Int. Cl.[7] ..... F02M 25/07
(52) U.S. Cl. ..... 123/568.11; 123/568.21; 251/129.15
(58) Field of Search ..... 251/129.11–129.15; 123/568.21–568.29, 568.11

(56) References Cited

U.S. PATENT DOCUMENTS

| | | | | | |
|---|---|---|---|---|---|
| 4,044,737 | A | * | 8/1977 | Nishimura | 123/568.29 |
| 4,898,393 | A | * | 2/1990 | Rollins | 277/500 |
| 5,052,363 | A | * | 10/1991 | Stiles | 123/568.29 |
| 6,053,473 | A | * | 4/2000 | Shinobu et al. | 123/568.26 |
| 6,135,415 | A | * | 10/2000 | Kloda et al. | 123/568.24 |

* cited by examiner

*Primary Examiner*—Henry C. Yuen
*Assistant Examiner*—Arnold Castro

(57) ABSTRACT

A powdered metal bearing (40) that guides a pintle (42) in an EGR valve (20) is sealed against infiltration of exhaust gases by mechanical processing or by applying a sealant.

14 Claims, 1 Drawing Sheet

BEARING POROSITY CONTROL IN AN EXHAUST GAS RECIRCULATION VALVE

FIELD OF THE INVENTION

This invention relates generally to emission control valves that are used in emission control systems associated with internal combustion engines in automotive vehicles. The invention particularly relates to an exhaust gas recirculation (EGR) valve.

BACKGROUND OF THE INVENTION

Controlled engine exhaust gas recirculation is a known technique for reducing oxides of nitrogen in products of combustion that are exhausted from an internal combustion engine to atmosphere. A typical EGR system comprises an EGR valve that is controlled in accordance with engine operating conditions to regulate the amount of engine exhaust gas that is recirculated to the fuel-air flow entering the engine for combustion so as to limit the combustion temperature and hence reduce the formation of oxides of nitrogen.

Because they are typically engine-mounted, EGR valves are subject to harsh operating environments that include wide temperature extremes and vibrations. Tailpipe emission requirements impose stringent demands on the control of such valves. An electric actuator, such as a solenoid that includes a sensor for signaling position feedback to indicate the extent to which the valve is open, can provide the necessary degree of control when properly controlled by the engine control system. An EGR valve that is operated by an electric actuator is often referred to as an EEGR valve.

Individual parts of an EGR valve must not only be strong, tightly toleranced, thermally insensitive, and essentially immune to combustion products present in engine exhaust gases, but they must also be cost-effective.

A cost-effective construction for the bearing in an EEGR valve comprises fabricating the bearing using powdered metal technology. A powdered metal bearing fabricated from stainless steel powder is well suited for use in the harsh environment of hot engine exhaust gases.

Increasingly stringent demands on valve performance, life, and reliability have led to the discovery that even small amounts of exhaust gas leakage through an EEGR valve bearing can be detrimental to valve performance over time.

SUMMARY OF THE INVENTION

The present invention is directed to a solution for improving the resistance of a powdered metal EEGR bearing to exhaust gas leakage. The improvement allows the continued use of powdered metal technology for the fabrication of such bearings without the necessity of making major constructional modifications to either the bearing or the EEGR valve.

A powdered metal part possesses some inherent degree of porosity. Because of that porosity gases can infiltrate and migrate through the part. A result of such infiltration and migration that has been observed in an EEGR valve bearing is the accumulation of material on the bearing surface that guides the stem, or shaft, of the valve pintle. That is not to say that the accumulation of material is due solely to migration through the porous bearing material, but rather it means that at least some accumulation is believed attributable to bearing porosity.

U.S. Pat. No. 5,041,168 discloses a process for infiltrating material into the guide surface of a powdered metal engine valve guide for the purpose of improving certain characteristics of the stem/guide interface. The process involves rolling sheet material into a cylinder and inserting it into the valve guide bore. That patent does not appear to be concerned with controlling the bearing porosity in a manner that would resist leakage of combustion gases through surfaces other than the guide bore surface. A general aspect of the invention relates to an EGR valve comprising valve body structure providing an exhaust gas passage that is selectively restricted by a valve operated by an actuator via an operative coupling that comprises a linearly positionable shaft guided by a guide bore of a powdered metal bearing that is fit to the valve body structure in closure of an opening to the exhaust gas passage thereby exposing a surface portion of the bearing that is exterior to the guide bore to exhaust gas flow through the passage.

At least that surface portion of the bearing is sealed to essentially stop infiltration of exhaust gas through that surface portion into the powdered metal.

Another general aspect relates to a method of making such a bearing.

Still another general aspect relates to an engine having an exhaust gas recirculation system that comprises a valve having such a bearing.

The accompanying drawings, which are incorporated herein and constitute part of this specification, include one or more presently preferred embodiments of the invention, and together with a general description given above and a detailed description given below, serve to disclose principles of the invention in accordance with a best mode contemplated for carrying out the invention.

DESCRIPTION OF THE PREFERRED EMBODIMENT

Figure 1:
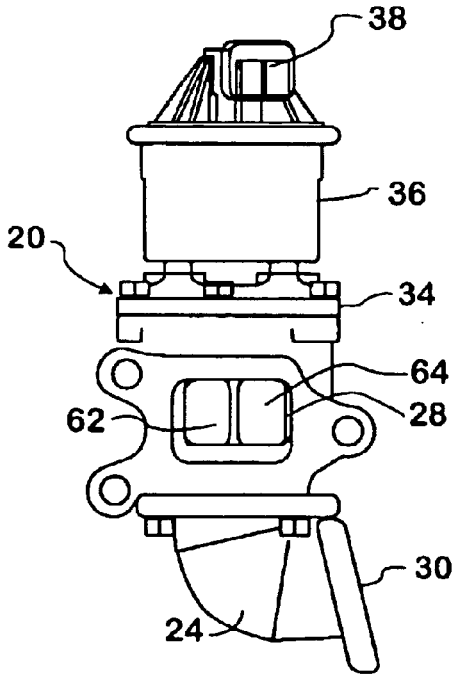
FIG. 1 is a front elevation view of an exemplary EEGR valve embodying principles of the invention.
Figure 2:
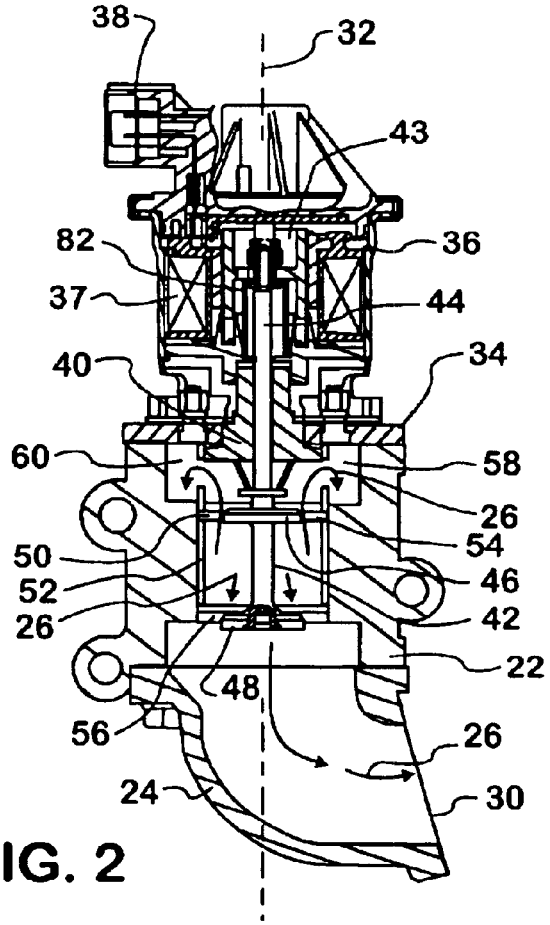
FIG. 2 is an enlarged cross section view of the valve.

FIGS. 1 and 2 illustrate an exemplary EEGR valve 20 embodying principles of the present invention. Valve 20 comprises a base 22 and an elbow 24 assembled together to form a flow path 26 through the valve between an inlet port 28 provided in a flange at a side of base 22 and an outlet port 30 provided in a flange at one end of elbow 24.

Base 22 is a metal part that has a main longitudinal axis 32. Base 22 may be considered to have a generally cylindrical shape about axis 32 comprising a generally cylindrical wall bounding an interior space that is open at opposite axial end faces of the base. Base 22 is constructed so that its interior space is also open to inlet port 28.

An end of elbow 24 that is opposite the end containing outlet port 30 is fastened in a sealed manner to the lower end face of base 22 so that the interior of elbow 24 is open to the interior space of base 22. A cover 34 is fastened in a sealed manner to the upper end face of base 22 to close that end of the interior space of base 22 while providing a platform for the mounting of an electric actuator 36 on the exterior of the cover.

Actuator 36 comprises a solenoid 37 that, when the valve is installed on an engine in a motor vehicle, is electrically connected via an electric connector 38 to an electrical system of the motor vehicle to place the valve under the control of an engine controller in the vehicle.

Figure 3:
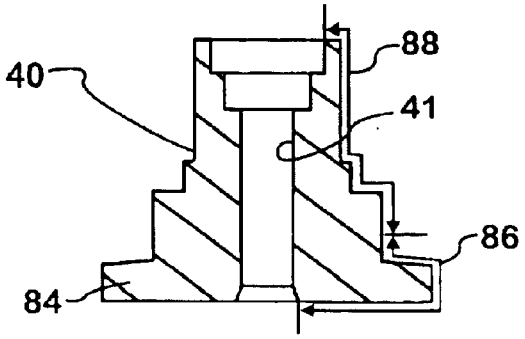
FIG. 3 is an enlarged cross section view of the valve bearing.

A bearing 40 is centrally fit to cover 34 such that a guide bore 41 (see FIG. 3) of the bearing is coaxial with axis 32. Bearing 40 serves to axially guide a double-pintle 42 of valve 20 along axis 32 via a guiding fit of the bearing guide bore to an upper portion of a stem 44 of double-pintle 42 that extends completely through the bearing guide bore from an armature 43 of solenoid 37 into the interior space of base 22 where upper and lower pintles 46, 48 are disposed on stem 44.

A double-seat element 50 is fit to base 22 within the latter's interior space. Element 50 has a generally cylindrical wall 52 that is coaxial with axis 32 and that is open at opposite axial ends. Element 50 comprises axially spaced apart upper and lower seats 54, 56 with which pintles 46, 48 respectively cooperate.

Wall 52 comprises two pairs of openings, or apertures: an upper pair 58, 60, and a lower pair 62, 64. The lower pair are arranged axially between seats 54, 56 to provide for the open interior of element 50 that is circumscribed by wall 52 between seats 54, 56 to communicate through the opening in base 22 to inlet port 28. The upper pair 58, 60 are arranged axially beyond seat 54 relative to the lower pair 62, 64 to provide for the open interior of element 50 that is circumscribed by wall 52 beyond upper seat 54 to communicate with respective entrances to an internal passageway than runs within base 22 internally through a portion of the generally cylindrical wall of the base that is in the semicircumferential portion of that wall opposite inlet port 28. Apertures 62, 64 are in registration with inlet port 28.

With the solenoid not being energized, each of the two pintles 46, 48 seats on the respective seat 54, 56, closing the respective through-hole. Armature 43 is biased by a spring 82 to urge the pintles against the seats with an appropriate amount of force. A flange, or rim, 84 at the lower end of bearing 40 fits to the open upper end of seat element 50.

When valve 20 is operated open, the entering exhaust gas flow divides more or less equally as it passes through seat element 50. The mounting of bearing 40 exposes its lower axial end portion to exhaust gas flow that has passed through upper seat 54.

In accordance with principles of the invention, the exposed surface of at least that portion of the bearing is sealed to stop infiltration of diesel exhaust gas into the powdered metal of the part and ensuing migration of the gas through the part. Depending on the nature of the specific process that is performed to accomplish the sealing and/or on relevant specifications applicable to the part, sealing of the surface of guide bore 41 may or may not occur.

The sealing process will seal at least the axial end face and an adjoining portion of the axial exterior surface that extends from the end face. That sealed surface portion is represented by the zone marked 86 in FIG. 3. The sealing may even be so extensive as to seal the entire surface that is external to guide bore 41, including a further zone marked 88 in FIG. 3. Where the bearing has counterbores at the opposite axial end as in the illustrated example, their surfaces may or may not be sealed. Likewise the small lead at the lower end of the guide bore may or may not be sealed.

Sealing may be accomplished by a mechanical process or by application of a suitable sealant. An example of mechanical sealing is a tumbling process or shot peening process where one or more bearings to be processed are tumbled in a container. The container contains media that repeatedly impact the exterior surfaces of the bearings to effectively close the pores present in those surfaces without adversely impairing the dimensional integrity of the part. The sealed surface would be represented by zones 86, 88.

A suitable sealant must be able to withstand conditions to which an EGR valve is subjected when in use with an engine. Examples of suitable sealants and processes for applying them can be performed by a company like Allegheny Coatings, Ridgway, Pa., using its "1092 inorganic presealer" or "Sermaguard". Introduction of sealant fills at least the surface pores, and may extend even deeper into the powdered metal.

While the foregoing has described a preferred embodiment of the present invention, it is to be appreciated that the inventive principles may be practiced in any form that falls within the scope of the following claims.

What is claimed is:

1. An EGR valve comprising:

valve body structure comprising an exhaust gas passage that is selectively restricted by a valve element operated by an actuator via an operative coupling that comprises a linearly positionable shaft guided by a guide bore of a powdered metal bearing that is fit to the valve body structure in closure of an opening to the exhaust gas passage thereby exposing a surface portion of the bearing that is exterior to the guide bore to exhaust gas flow through the passage, wherein at least that surface portion of the bearing is sealed to essentially stop infiltration of exhaust gas through that surface portion into the powdered metal.

2. An EGR valve as set forth in claim 1 wherein that surface portion of the bearing comprises an axial end face of the bearing.

3. An EGR valve as set forth in claim 2 wherein that surface portion of the bearing further comprises an adjoining portion of an axial surface extending axially away from the axial end face.

4. An EGR valve as set forth in claim 1 wherein that surface portion of the bearing comprises the entire surface area of the bearing excluding substantially the entire surface of the guide bore.

5. A method of making a powdered metal bearing for guiding a pintle shaft in an EGR valve, the method comprising:

providing a powdered metal bearing part having a guide bore extending between opposite axial ends of the part, one axial end surface portion of which is exterior to the guide bore and exposed to engine exhaust gases passing through the valve, and sealing at least that surface portion of the bearing to essentially stop infiltration of exhaust gas through that surface portion into the powdered metal part.

6. A method as set forth in claim 5 wherein the step of sealing at least that surface portion of the bearing to essentially stop infiltration of exhaust gas through that surface portion into the powdered metal part comprises sealing an entire axial end face of the bearing.

7. A method as set forth in claim 6 wherein the step of sealing at least that surface portion of the bearing to essentially stop infiltration of exhaust gas through that surface portion into the powdered metal part further comprises sealing an adjoining portion of an axial surface extending axially away from the axial end face.

8. A method as set forth in claim 5 wherein the step of sealing at least that surface portion of the bearing to essentially stop infiltration of exhaust gas through that surface portion into the powdered metal part comprises sealing the entire surface area of the bearing excluding substantially the entire surface of the guide bore.

9. A method as set forth in claim 8 wherein the step of sealing the entire surface area of the bearing excluding substantially the entire surface of the guide bore comprises mechanically treating the entire surface area of the bearing excluding substantially the entire surface of the guide bore.

10. A method as set forth in claim 5 wherein the step of sealing at least that surface portion of the bearing to essentially stop infiltration of exhaust gas through that surface portion into the powdered metal part comprises applying a sealant to at least that surface portion.

11. An internal combustion engine comprising an exhaust gas recirculation system for recirculating some engine exhaust gas through the engine via an exhaust gas recirculation valve external to engine combustion chambers, wherein the valve comprises:

valve body structure comprising an exhaust gas passage that is selectively restricted by a valve element operated by an actuator via an operative coupling that comprises a linearly positionable shaft guided by a guide bore of a powdered metal bearing that is fit to the valve body structure in closure of an opening to the exhaust gas passage thereby exposing a surface portion of the bearing that is exterior to the guide bore to exhaust gas flow through the passage, wherein at least that surface portion of the bearing is sealed to essentially stop infiltration of exhaust gas through that surface portion into the powdered metal.

12. An engine as set forth in claim 11 wherein that surface portion of the bearing comprises an axial end face of the bearing.

13. An engine as set forth in claim 12 wherein that surface portion of the bearing further comprises an adjoining portion of an axial surface extending axially away from the axial end face.

14. An engine as set forth in claim 11 wherein that surface portion of the bearing comprises the entire surface area of the bearing excluding substantially the entire surface of the guide bore.

* * * * *